US012179078B2

(12) United States Patent
Bingham

(10) Patent No.: US 12,179,078 B2
(45) Date of Patent: Dec. 31, 2024

(54) PADDLESMASH OUTDOOR GAME

(71) Applicant: Glacier Games, LLC, Alpine, UT (US)

(72) Inventor: Joe Bingham, Pleasant View, UT (US)

(73) Assignee: GLACIER GAMES, LLC, Alpine, UT (US)

( * ) Notice: Subject to any disclaimer, the term of this patent is extended or adjusted under 35 U.S.C. 154(b) by 0 days.

(21) Appl. No.: 18/037,350

(22) PCT Filed: Sep. 13, 2022

(86) PCT No.: PCT/US2022/043306

§ 371 (c)(1),
(2) Date: May 17, 2023

(87) PCT Pub. No.: WO2023/055561

PCT Pub. Date: Apr. 6, 2023

(65) Prior Publication Data

US 2023/0415012 A1 Dec. 28, 2023

Related U.S. Application Data

(60) Provisional application No. 63/249,356, filed on Sep. 28, 2021.

(51) Int. Cl.
*A63B 67/00* (2006.01)
*A63B 59/42* (2015.01)
(Continued)

(52) U.S. Cl.
CPC ..... *A63B 67/002* (2013.01); *A63B 59/42* (2015.10); *A63B 60/56* (2015.10); *A63B 63/007* (2013.01);
(Continued)

(58) Field of Classification Search
CPC ..... A63B 67/002; A63B 67/04; A63B 59/42; A63B 60/56; A63B 63/007;
(Continued)

(56) References Cited

U.S. PATENT DOCUMENTS 1,144,112 A 6/1915 Denny
3,738,653 A 6/1973 Simpson
(Continued)

FOREIGN PATENT DOCUMENTS

CN 115155023 A * 10/2022
WO WO-2023055561 A1 * 4/2023 ..... A63B 59/42

OTHER PUBLICATIONS

International Preliminary Report on Patentability for International Application No. PCT/US2022/043306 mailed Apr. 11, 2024.
(Continued)

*Primary Examiner* — Raleigh W Chiu
(74) *Attorney, Agent, or Firm* — Carlson, Gaskey & Olds, P.C.

(57) ABSTRACT

A paddle ball game includes a court defined by a base with an action surface and a net supported by poles extending upward and outward from the action surface. The game is played with opposing players that strike the ball with a paddle into the court for the other player to hit until one player misses the ball or the ball fails to rebound out of the court.

17 Claims, 9 Drawing Sheets

(51) Int. Cl.
*A63B 60/56* (2015.01)
*A63B 63/00* (2006.01)

(52) U.S. Cl.
CPC ..... *A63B 2063/001* (2013.01); *A63B 2210/50* (2013.01)

(58) Field of Classification Search
CPC ..... A63B 2063/001; A63B 2210/50; A63C 19/08; A63C 2019/085; A63F 7/0652
See application file for complete search history.

(56) References Cited

U.S. PATENT DOCUMENTS 8,430,772 B1 4/2013 Jones
10,758,763 B1 * 9/2020 Chen ..... A63G 9/00
2015/0157889 A1 * 6/2015 Miller ..... A63B 71/022 482/27
2015/0335993 A1 11/2015 Attenweiler
2016/0296781 A1 * 10/2016 Andon ..... A63B 5/11
2016/0367878 A1 * 12/2016 Bell ..... A63B 67/10
2017/0340939 A1 * 11/2017 Chen ..... A63B 67/10
2018/0290000 A1 * 10/2018 Chen ..... A63B 71/022
2018/0326244 A1 * 11/2018 Andon ..... A63B 5/11
2018/0369629 A1 * 12/2018 Publicover ..... A63B 5/11
2020/0238152 A1 * 7/2020 Hagel ..... A63B 21/0428
2020/0384338 A1 * 12/2020 Chen ..... A63B 71/023
2021/0093939 A1 * 4/2021 Shirley-Smith ..... E04H 15/02
2021/0121756 A1 4/2021 Moran

OTHER PUBLICATIONS

International Search Report and Written Opinion for International Application No. PCT/US2022/043306 mailed Dec. 19, 2022.

* cited by examiner

PADDLESMASH OUTDOOR GAME

REFERENCE TO RELATED APPLICATION

This application claims priority to U.S. Provisional Application No. 63/249,356 filed on Sep. 28, 2021.

BACKGROUND

Multi-player games are available in many different variations to suit players of different fitness and skill levels. Some games are more passive and do not require direct player interaction. Other games provide direct engagement and interaction between opposing players. Moreover, direct interaction between opposing players fosters friendly competition that results in increased interest, enjoyment and activity for participants.

The background description provided herein is for the purpose of generally presenting a context of this disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

A paddle ball game according to an example disclosed embodiment includes, among other possible things, a base defining an action surface, poles attached to the base such that the poles extend upward and outward from the base and a net supported by the poles. The net expands upward and outward from the action surface. The net and action surface define a court into which a ball is hit by one player with a paddle onto the action surface. The ball rebounds from the action surface outward from the court for an opposing player to strike back into the court to rebound from the action surface for hitting by the first player. Play continues until one player misses the ball or the ball fails to rebound out of the court.

Although the different examples have the specific components shown in the illustrations, embodiments of this disclosure are not limited to those particular combinations. It is possible to use some of the components or features from one of the examples in combination with features or components from another one of the examples.

These and other features disclosed herein can be best understood from the following specification and drawings, the following of which is a brief description.

DESCRIPTION

Figure 1:
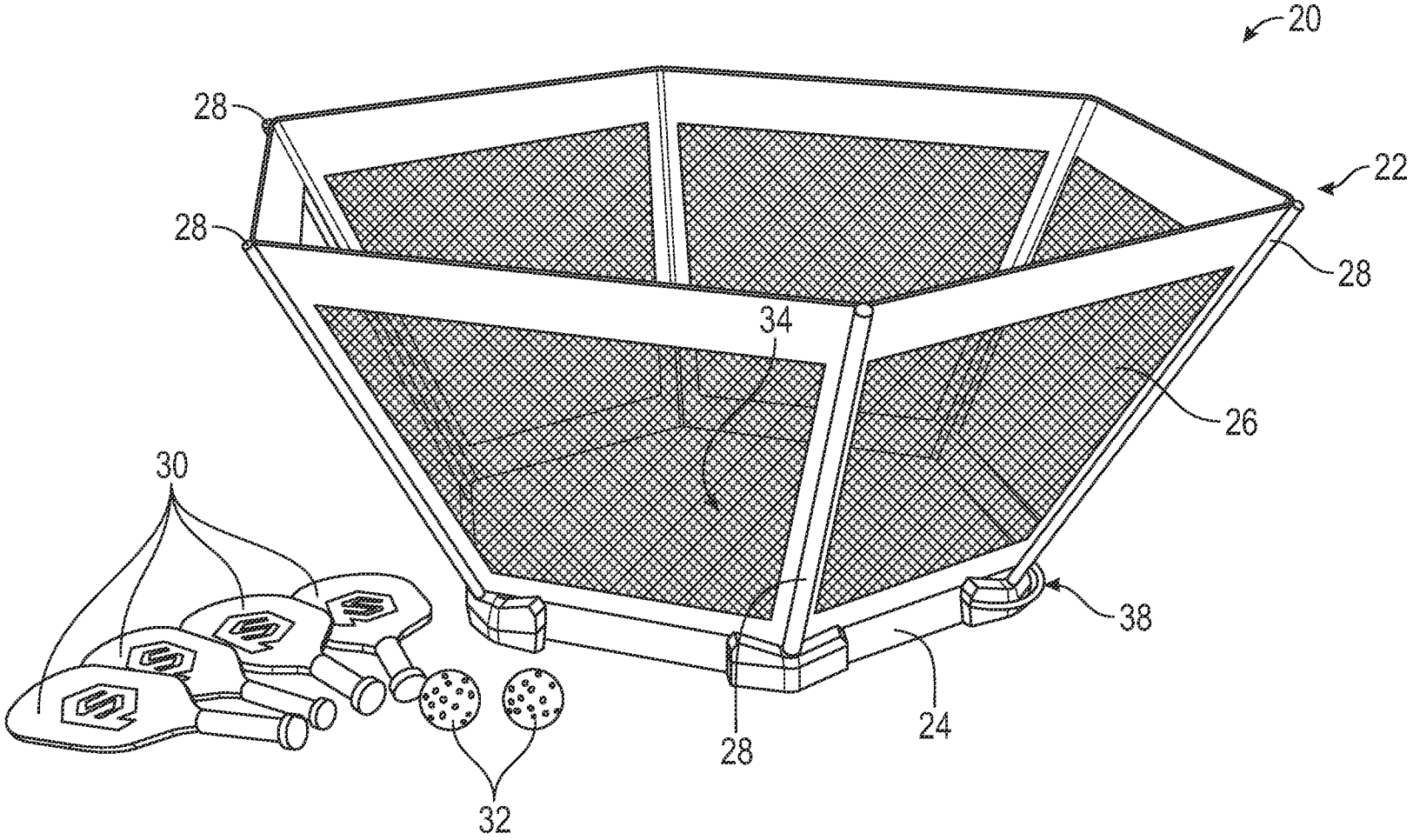
FIG. 1 is a perspective view of a disclosed example paddle ball game system embodiment.
Figure 2:
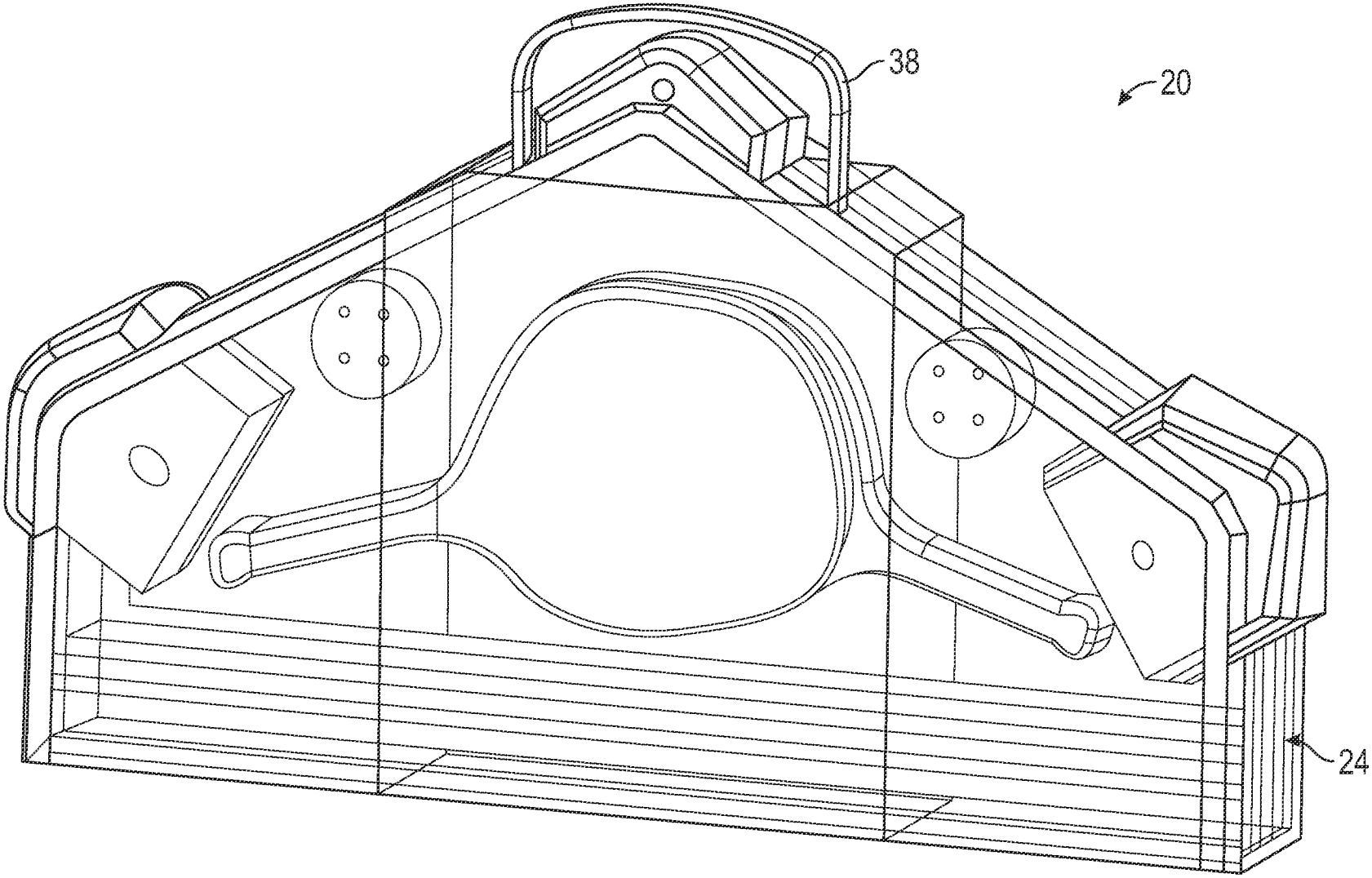
FIG. 2 is a perspective view of the example paddle ball game system in a stowed configuration.

Referring to FIGS. 1 and 2, a paddle ball game system is schematically shown and indicated at 20. The game system 20 includes a court 22 paddles 30 and at least one ball 32. The game is generally played by opposing players arranged around the court 22 that alternate hitting a ball 32 into the court 22 without allowing the ball to hit the ground. The players are challenged to continually move around the court 22 to return a ball hit by the opposing team/player.

In one disclosed example method of play, players are split into at least two teams and use a paddle 30 to alternate hitting the ball 32 into the court 22. The game begins with one player hitting the ball 32 using the paddle 30 into the court 22. The ball 30 will bounce of an action surface 34 and out of the court 22 into the air. A player from the opposing team is then challenged to hit the ball 32 back into the court 22 before the ball 32 hits the ground. Hitting of the ball alternates between teams until one team misses the ball or a hit ball does not bounce out of the court 22. Points are awarded and the game will then continue until a set number of points is attained by one of the teams.

The teams may comprise a single player or multiple players. Players may be allowed several hits of the ball prior to the ball being hit back into the court 22. In one disclosed example method of playing the game, each team is allowed three hits to direct the ball 32 back into the court 22. As appreciated, different rules can be applied to play of the game using the disclosed system 20 and are within the contemplation of this disclosure.

The disclosed court 22 includes a base 24 with a net 26 extending upward and outward from the base 24. The base 24 includes the action surface 34 and a place for attaching poles 28. The net 26 is supported by the poles 28 attached to the base 24. In one example embodiment, the base 24 is foldable to define a case with a handle 38 (FIG. 2). The foldable base 24 provides an interior space for storage of paddles 30, poles 28 and balls 32.

Figure 3:
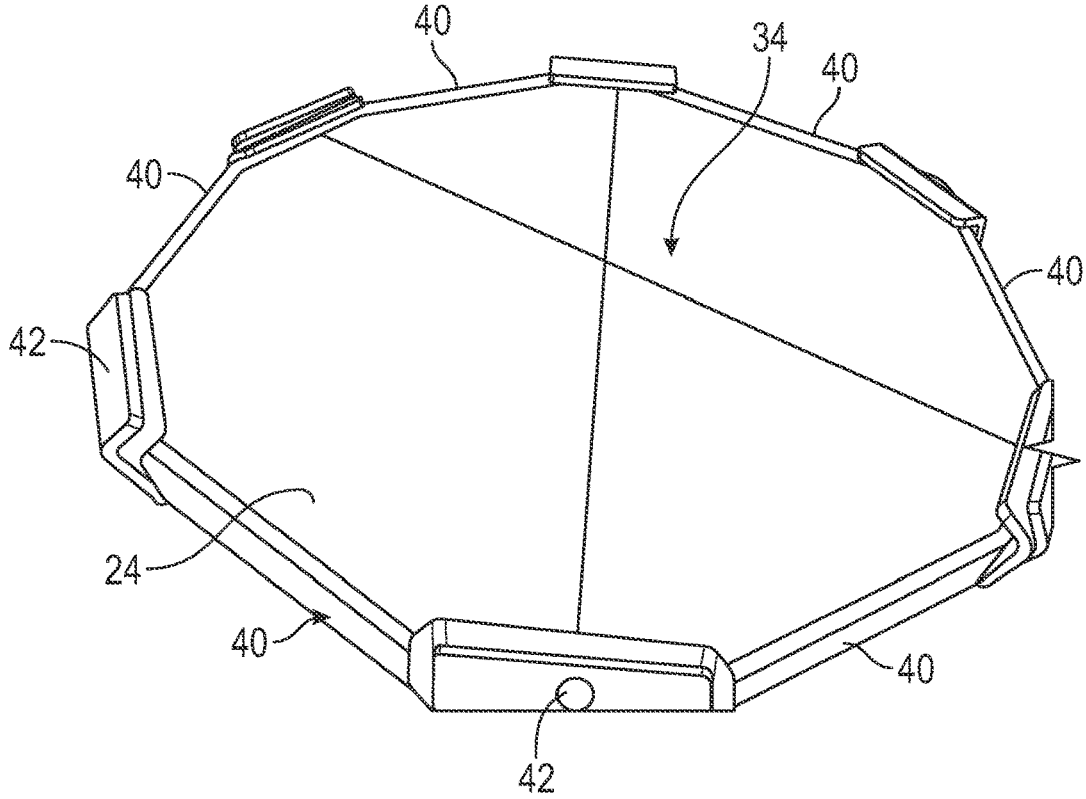
FIG. 3 is a perspective view of an action surface of a base.
Figure 4:
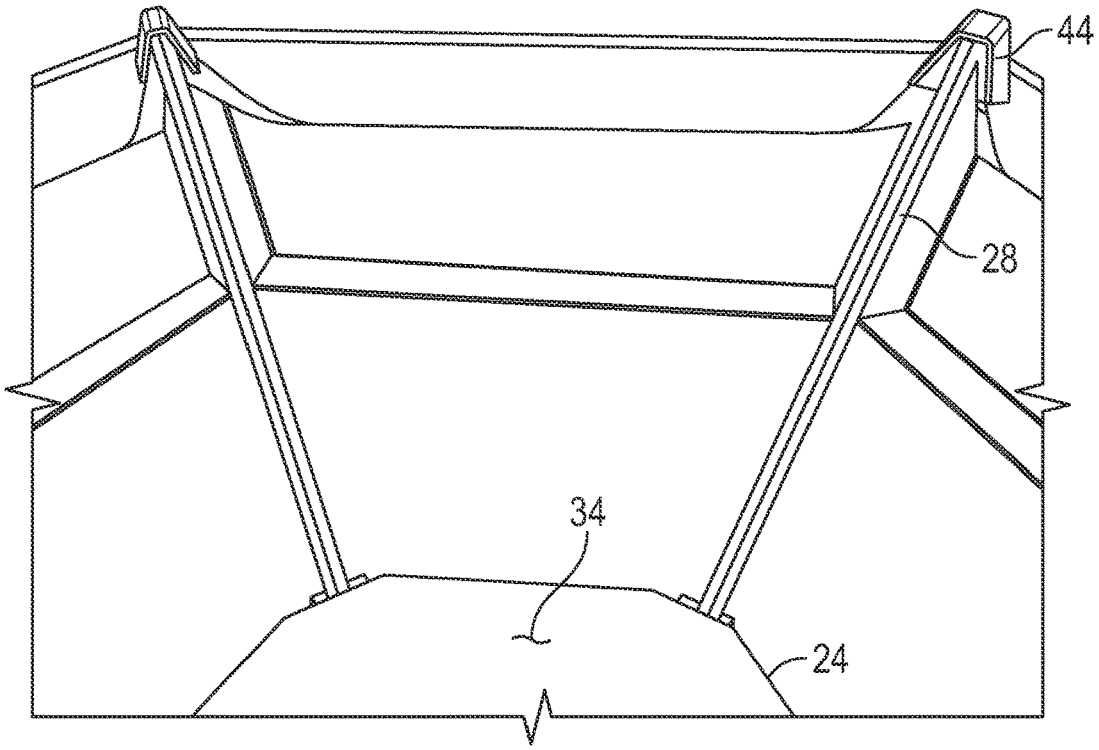
FIG. 4 is a perspective view of a portion of a net extending upward and outward from the base.
Figure 5:
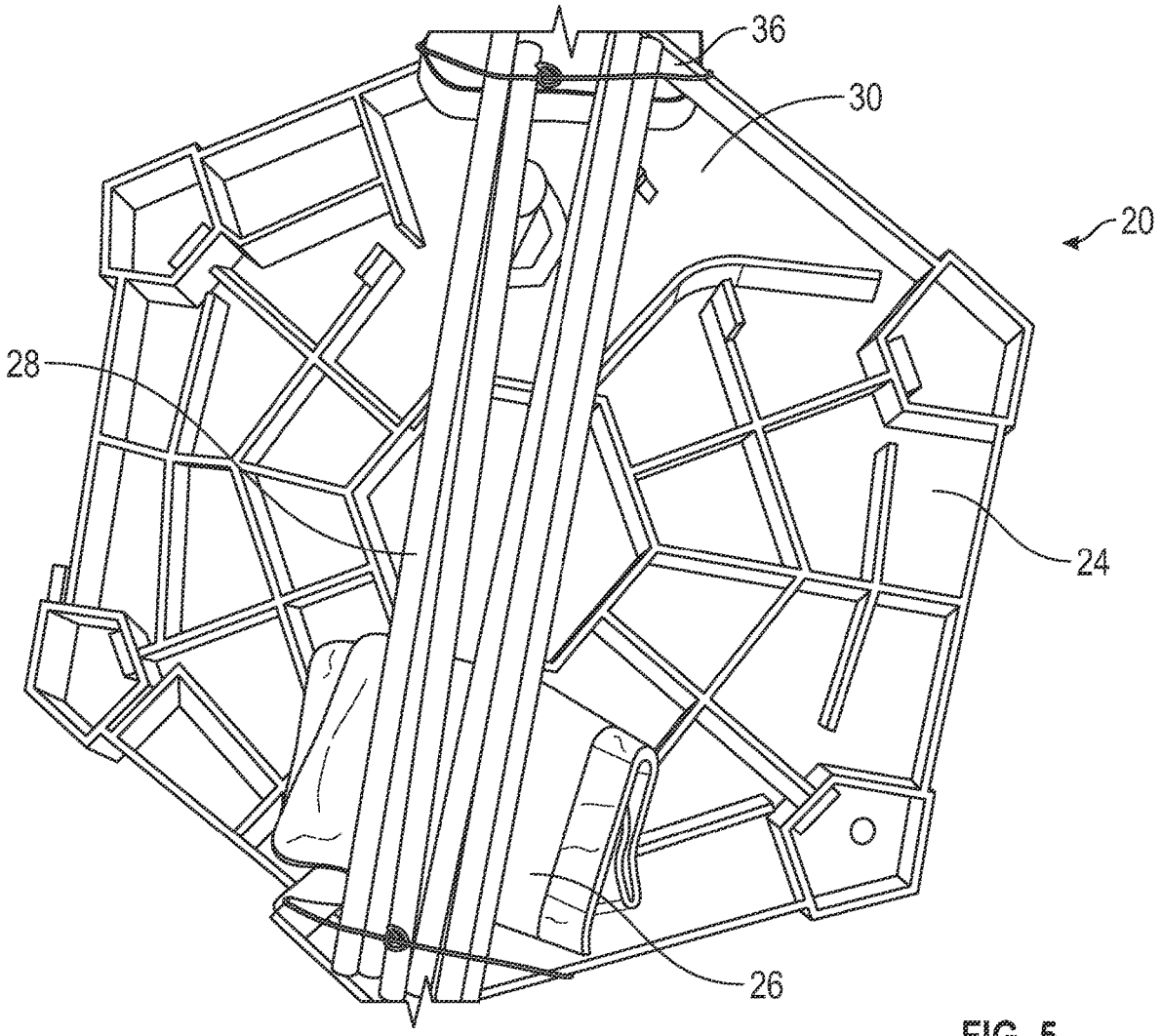
FIG. 5 is a view of a bottom of the base and part of the paddle ball game system.

Referring to FIGS. 3, 4 and 5 with continued reference to FIGS. 1 and 2, the action surface 34 is a flat hard surface off which a struck ball 32 will bounce. In this disclosed example, the base 24 is a hexagon with six sides 40. Other shapes could be utilized and are within the scope and contemplation of this disclosure.

The intersection between each of the sides 40 includes an opening 42 for a pole 28. The net 26 is also hexagon shaped when assembled and supported on the outward extending poles 28. The poles 28 and thereby the net 26 is angled outward relative to the action surface 34. The openings 42 are therefore also angled outward to provide the desired outward angle of the net 26. The net 26 increases the difficulty of hitting a ball 32 back onto the action surface 34 by setting a minimum angle and height from which a hit ball must bounce to exit the court 22 to remain in pay. Similarly, the net 26 defines a minimum height and angle that a hit ball must travel to impact the action surface 34. A ball that hits the net 26 and does not exit the court 22 is no longer in play and results in a point being scored to the opposing team/player.

Although a hexagon shape is disclosed by way of example, the court 22 could be shaped differently and still be within the contemplation and scope of this disclosure. The court 22 could be round, square or some other polygon shape. Moreover, the overall size could be increased or decreased within the contemplation of this disclosure.

The example net 26 includes a pocket 44 that receives an upper end of a corresponding pole 28. A bottom of the net 26 is secured either to a bottom end of the pole 28 or to a portion of the base 24. The net 26 may also includes a sleeve that receives a corresponding pole 28. As appreciated, the net may be attached to the poles 28 in other ways that are within the scope and contemplation of this disclosure.

A bottom side of the base 24 is shown in FIG. 5 and includes ribs that add to the rigidity of the action surface 34. The ribs are arranged such that the base 24, and more specifically the action surface 34 will remain sufficiently stiff to provide for the balls 32 to bounce out of the court 22. The ribs enable formation of the base 24 in a lighter form while maintaining the desired rigidity that results in rebounding of a hit ball 32 from the court 22.

Figure 6:
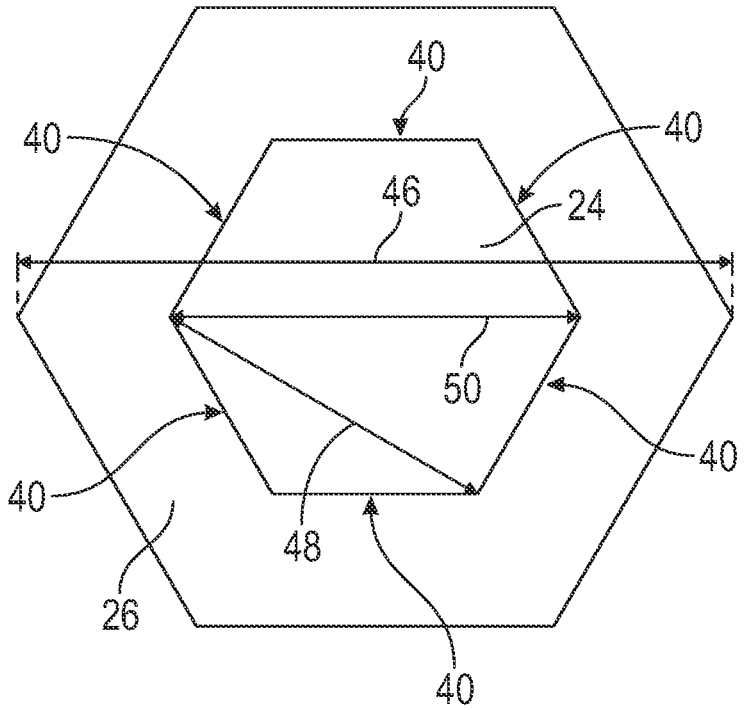
FIG. 6 is a schematic top view of the example paddle ball game system.
Figure 7:
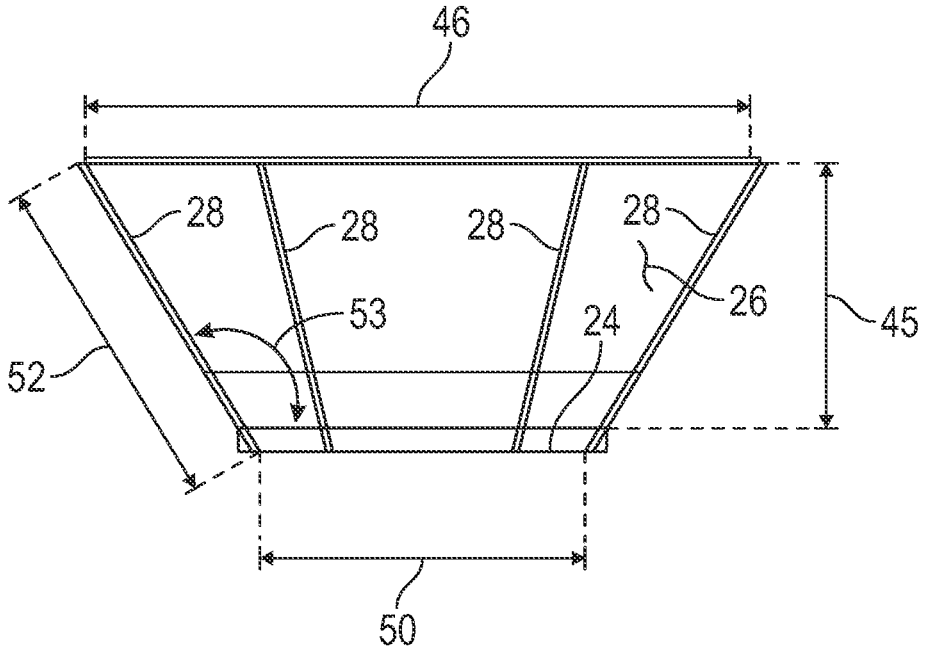
FIG. 7 is a side view of the example paddle ball game system.

Referring to FIGS. 6 and 7, the example court 22 is an expanding hexagon shape with the net 26 expanding upward and outward from the base 24. The base 24 includes a base width 50 and the net forms an opening width 46. The width 50 is across the base at the intersection of sides. A width 48 of the base 24 between sides is less than the width 50. In one disclosed embodiment, the opening width 46 is between about 1½ and 3 times the base width 48. In another disclosed example embodiment, the opening width is about two times as wide as the base width 48. In another disclosed embodiment, the base width 48 is about 30 inches and the opening width 46 is 60 inches. It should be understood that the example widths are provided by way of example and that other sizes are within the contemplation and scope of this disclosure.

The net 26 extends upward and outward from the base 24 to a height 45. The height 45 is provided by poles 28 of a length 52 disposed at an angle 53 from the base 24. In one disclosed example, the height 45 is between about 20 inches and 30 inches. In another disclosed example, the height is 24 inches. In one disclosed example the length 52 is between about 24 inches and 36 inches. In another disclosed example. The length 52 is about inches. In one disclosed example embodiment, the angle 53 is between 30 degrees and 75 degrees. In another disclosed embodiment, the angle 53 is about 60 degrees. The angle 53 is set by an angle of the openings 42 (Shown in FIG. 3) that receive the poles 28. As appreciated, other heights, lengths and angles could be utilized and are within the scope and contemplation of this disclosure.

Figure 8:
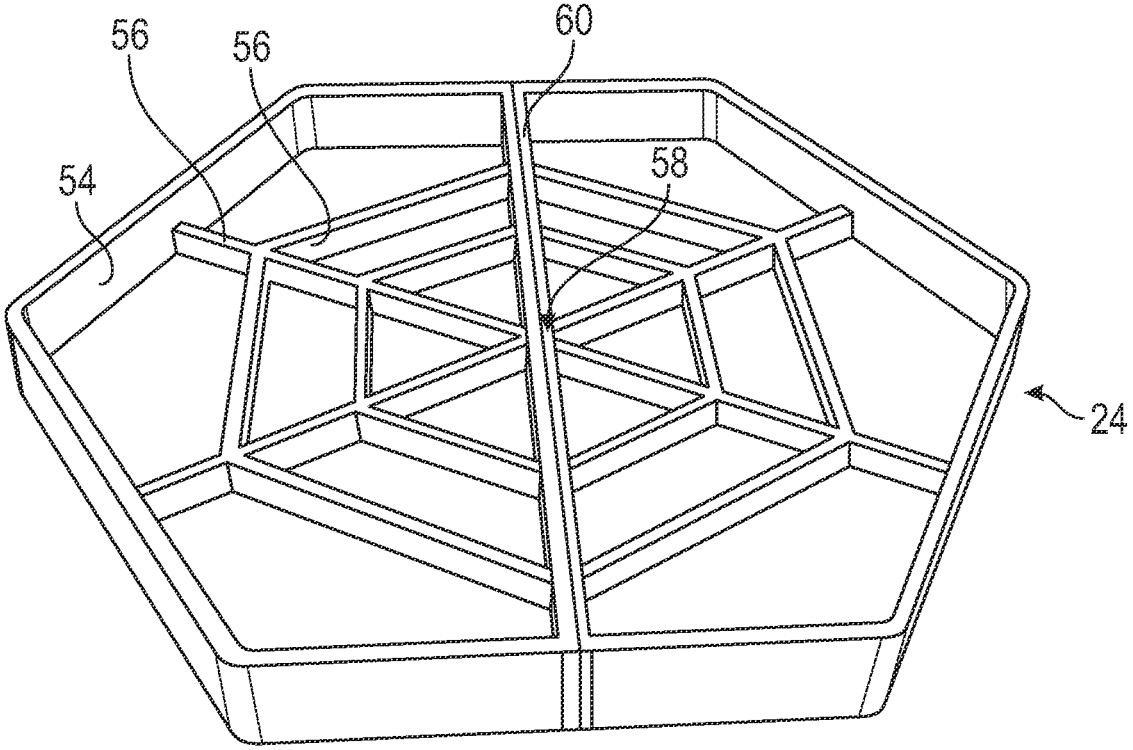
FIG. 8 is a perspective view of the bottom of the base.
Figure 9:
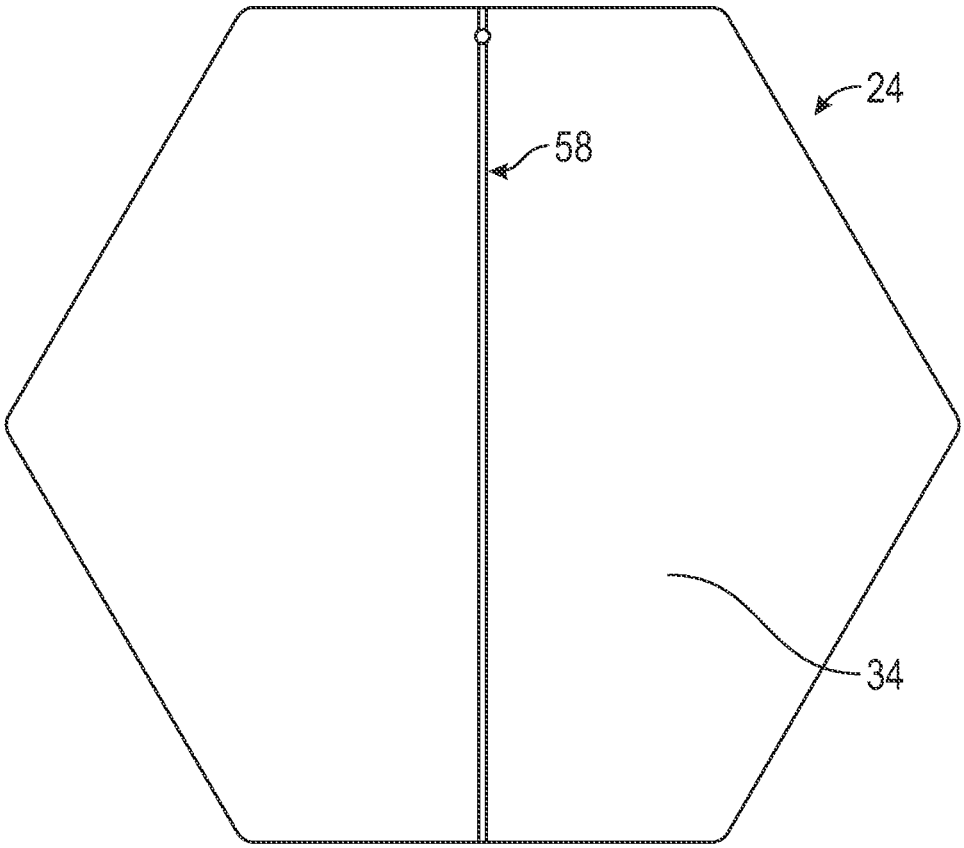
FIG. 9 is a top view of the base.
Figure 10:
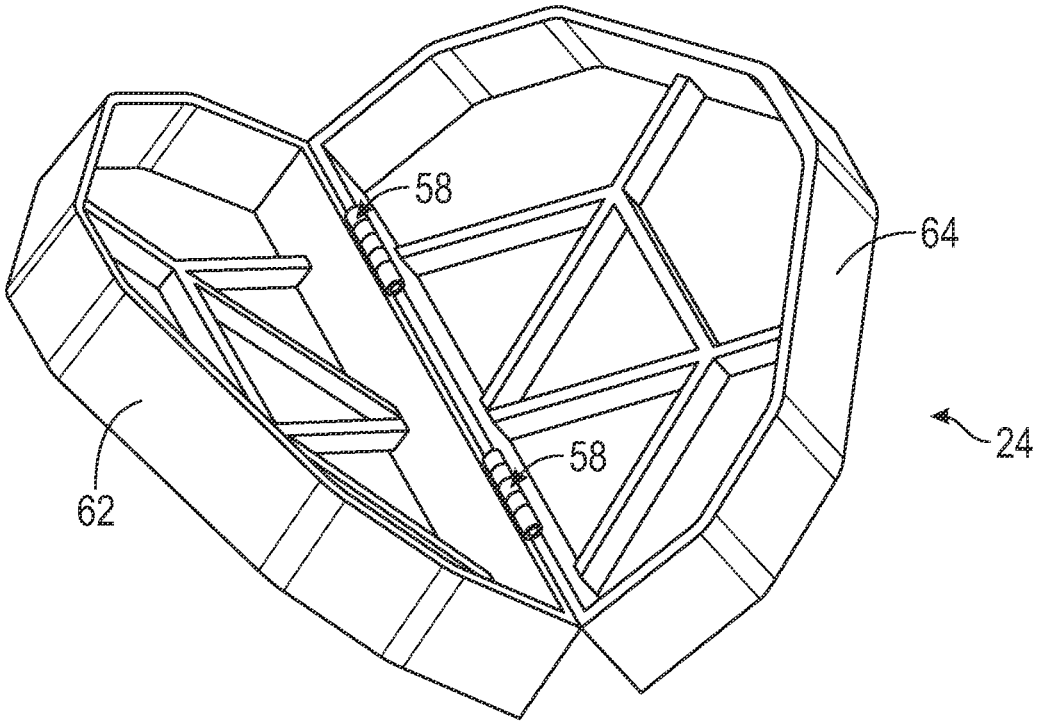
FIG. 10 is a schematic view of the base folded in a partially stowed configuration.

Referring to FIGS. 8, 9 and 10, a bottom side of the example base 24 is shown and includes an outer wall 54 and ribs 56 for strengthening the action surface 34. Inner walls 60 are provided at the intersection between each of a first half 62 and a second half 64 and attached by to each other by hinges 58. The inner walls 60 may be of a greater thickness than the outer walls 54 to accommodate stresses and fatigue generated by the hinges 58. The ribs 56 and outer walls 54 may be of a common thickness with the ribs arranged as needed to provide the desired rigidity without adding excessive weight to the base 24.

In the disclosed example, the base 24 is formed from moldable plastic material. The hinges 58 may be added structures or a molded in living hinge formed of the plastic material used to form the base 24. The base 24 will includes additional features to hold the base 24 in a folded position for use as a case as was illustrated in FIG. 2. The features could include molded tab and slot features or hardware attached to the base 24.

Figure 11:
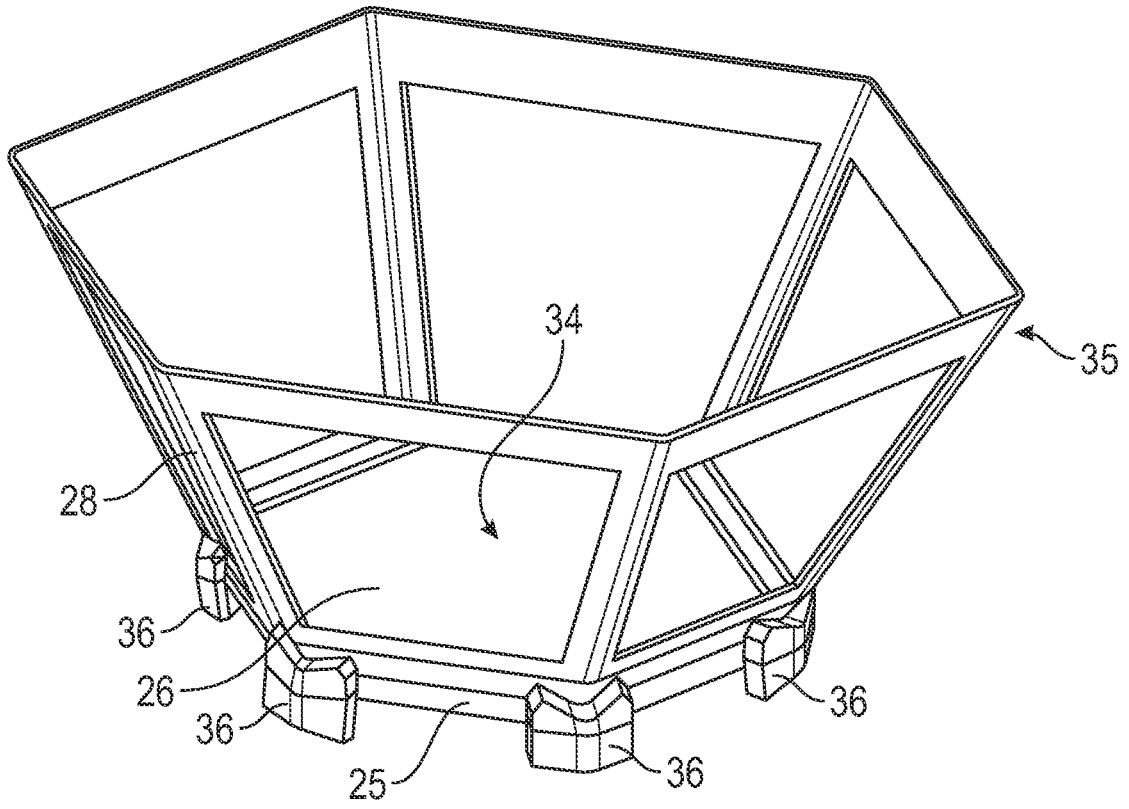
FIG. 11 is a perspective view of another example court embodiment.

Referring to FIG. 11, another disclosed example court embodiment 35 includes a base 25 with legs 36. The legs 36 support the base 25 above a support surface, such as the ground, lawn or floor. Like the previously disclosed base embodiment, the base includes the action surface 34 and locations for the poles 28 to support the net 26 defining the court 22.

Accordingly, the disclosed game systems provide a unique court for playing a paddle and ball game suitable to provide active entertainment for players of many different fitness and skill levels.

Although an example embodiment has been disclosed, a worker of ordinary skill in this art would recognize that certain modifications would come within the scope of this disclosure. For that reason, the following claims should be studied to determine the scope and content of this disclosure.

What is claimed is:

1. A paddle ball game system comprising:

a base including an action surface, wherein the base includes openings where poles are received that support a net;

a net extending upward about a periphery of the action surface, wherein the poles extend upward and outward at an angle from the action surface such that the net expands upward and outward from the action surface;

at least one paddle; and at least one ball provided for being hit against the action surface with the paddle.

2. The paddle ball game system as recited in claim 1, wherein the openings for the poles are disposed at an intersection between sides of the base.

3. The paddle ball game system as recited in claim 1, wherein the angle is between 30 degrees and 75 degrees.

4. The paddle ball game system as recited in claim 1, wherein an opening width defined across an upper end of the net is between 1½ and 3 times a width of the base.

5. The paddle ball game system as recited in claim 4, wherein the periphery of the action surface and a periphery about the opening width are the same shape.

6. The paddle ball game system as recited in claim 1, wherein base is generally a polygonal shape and the net is supported in the polygonal shape.

7. The paddle ball game system as recited in claim 1, wherein the base includes an inner storage compartment for storage of the parts of the game system.

8. The paddle ball game system as recited in claim 7, wherein the base comprises two halves attached to each other by hinges such that the two halves are foldable onto each other.

9. The paddle ball game system as recited in claim 1, wherein a back side of the base includes an outer wall disposed about an outer periphery and at least one inner rib strengthening the action surface.

10. The paddle ball game system as recited in claim 1, including legs for supporting the base a distance above a support surface.

11. A paddle ball game system comprising:

a base including an action surface;

poles attached to the base that extend upward and outward at an angle from the action surface;

a net supported by the poles that expands upward and outward from the action surface about a periphery of the action surface;

at least one paddle; and at least one ball provided for being hit against the action surface with the paddle.

12. The paddle ball game system as recited in claim 11, wherein the angle is between 30 degrees and 75 degrees.

13. The paddle ball game system as recited in claim 11, wherein an opening width defined across an upper end of the net is between 1½ and 3 times a width of the base.

14. The paddle ball game system as recited in claim 11, wherein the base comprises two halves attached to each other by hinges such that the two halves are foldable onto each other.

15. The paddle ball game system as recited in claim 11, including legs for supporting the base a distance above a support surface.

16. A method of playing a paddle ball game comprising:

serving a ball by hitting a ball with a paddle onto an action surface surround by a net;

hitting the ball after the ball bounces from the action surface back onto the action surface to an opposing player; and alternating between opposing players hitting of the ball with the paddle until one player fails to bounce the ball off the action surface and out of the net, wherein the net extends upward and outward from a base, the base defining the action surface and hitting the ball of the action surface to an opposing player includes hitting the ball at an angle off the action surface so that the ball is not caught in the net.

17. The method as recited in claim 16, wherein the opposing player has more than one hit to return and bounce the ball off the action surface.

* * * * *